US011963616B2

(12) United States Patent
Mackert

(10) Patent No.: US 11,963,616 B2
(45) Date of Patent: Apr. 23, 2024

(54) SEATING FURNITURE CHASSIS

(71) Applicant: Innotec Motion GmbH, Lippstadt (DE)

(72) Inventor: Michael Mackert, Rüthen (DE)

(73) Assignee: Innotec Motion GmbH, Lippstadt (DE)

( * ) Notice: Subject to any disclaimer, the term of this patent is extended or adjusted under 35 U.S.C. 154(b) by 182 days.

(21) Appl. No.: 17/492,168

(22) Filed: Oct. 1, 2021

(65) Prior Publication Data

US 2022/0087422 A1 Mar. 24, 2022

Related U.S. Application Data

(63) Continuation of application No. PCT/EP2020/058196, filed on Mar. 24, 2020.

(30) Foreign Application Priority Data

Apr. 3, 2019 (DE) ..... 202019101920.4

(51) Int. Cl.
*A47C 1/034* (2006.01)
*A47C 7/50* (2006.01)

(52) U.S. Cl.
CPC ..... *A47C 1/0342* (2013.01); *A47C 7/506* (2013.01)

(58) Field of Classification Search
CPC ..... A47C 1/0342; A47C 7/506
See application file for complete search history.

(56) References Cited

U.S. PATENT DOCUMENTS 58,343 A 9/1866 Hall
3,012,816 A * 12/1961 Lorenz ..... A47C 1/0355 297/85 R
3,363,942 A 1/1968 Fletcher
7,547,072 B1 * 6/2009 Delmestri ..... A47C 7/5068 297/423.21
8,794,706 B2 * 8/2014 Lin ..... A47C 7/5068 297/69
9,332,845 B2 * 5/2016 Nagayasu ..... B60N 2/995
2001/0033101 A1 10/2001 Plant
2012/0112517 A1 * 5/2012 Hoffman ..... A47C 1/0355 297/85 L
2016/0270537 A1 * 9/2016 Marshall ..... A47C 1/0355
2016/0302573 A1 10/2016 Garland et al.
2019/0159595 A1 * 5/2019 Fischer ..... C12Q 1/37

FOREIGN PATENT DOCUMENTS

DE 202007004695 U1 8/2008

OTHER PUBLICATIONS

Search Report in corresponding International Patent Application No. PCT/EP2020/058196, dated May 7, 2020, with English translation.

* cited by examiner

*Primary Examiner* — Philip F Gabler
(74) *Attorney, Agent, or Firm* — Edell, Shapiro & Finnan, LLC

(57) ABSTRACT

A seating furniture chassis comprises a seat surface frame, a lever mechanism, a footrest, a guide element, and a guide rail. The footrest is connected to the seat surface frame by the lever mechanism and is convertible between a folded-in state in which the footrest is arranged below the seat surface frame and a folded-out state in which the footrest forms an obtuse angle with the seat surface frame. The guide element is rigidly connected to the seat surface frame. When the footrest is converted between the folded-out and folded-in states, the guide element is guided in the guide rail, which has a curved shape.

14 Claims, 3 Drawing Sheets

100
101
102
103
104
105

100
101
103
106
107
108
109
110
111

SEATING FURNITURE CHASSIS

CROSS REFERENCE TO RELATED APPLICATIONS

This application is a continuation of International Application No. PCT/EP2020/058196, filed on Mar. 24, 2020, which claims priority under 35 U.S.C. § 119 to Application No. DE 202019101920.4 filed on Apr. 3, 2019, the entire contents of which are hereby incorporated by reference.

TECHNICAL FIELD

The present disclosure relates to a seating furniture chassis.

BACKGROUND

Seating furniture chassis with extendable footrests are known from the prior art. During a fold out movement of the footrest a seat surface frame of the seating furniture chassis is also moved translationally and/or is tilted.

In contrast, it is the object of the present disclosure to provide a seating furniture chassis in which the footrest can be folded in below the seat surface frame in a particularly space saving way.

SUMMARY

The disclosed seating furniture chassis comprises a seat surface frame, a footrest, a lever mechanism, a first guide element, and a first guide rail. The term "seat surface frame" is understood in the context of this description to mean a structure on which a cushion can be mounted when the seating furniture chassis is used as intended so that a person can sit on the cushion.

The footrest is connected to the seat surface frame by the lever mechanism. The footrest is convertible from a folded-in to a folded-out state and vice versa. In the folded-in state, the footrest is arranged below the seat surface frame. In the folded-out state the footrest forms an obtuse angle with the seat surface frame.

The seat surface frame is rigidly connected to the first guide element. When the footrest is converted from the folded-out state to the folded-in state and vice versa, the first guide element is guided in the first guide rail. This arrangement is understood to mean that the first guide element is moved and, in so doing, the direction of motion is determined by the first guide rail.

It is provided, according to the disclosed seating furniture chassis, that the first guide rail has a curved shape. This is understood to mean that the rail can be formed, for example, in an arc-shaped manner. For example, the shape may be free of corners. The curved shape has the advantage that the seat surface frame follows the curved shape during a fold out process of the footrest. This feature allows the footrest in the folded-in state to be arranged relatively close to the seat surface frame.

According to one disclosed embodiment, the first guide rail can have a front end, a rear end, and a central region arranged between the front end and the rear end. The front end and the rear end can be arranged lower than the central region. In this case the "front end" is understood to mean an end that is closer to the footrest in the folded-out state than the rear end. The rear end may be arranged closer to the mounting mechanism for a backrest than the front end. The term "lower arrangement" is understood in the context of this description to mean that the ends are closer to the Earth's surface than the central region when the seating furniture chassis is used as intended.

This shape of the guide rail gives rise to a very smooth fold out movement of the footrest that can be easily triggered by the user.

According to one disclosed embodiment, the first guide element in the folded-out state of the footrest can be arranged on the rear end of the first guide rail.

According to one disclosed embodiment, the first guide element in the folded-in state of the footrest can be arranged on the front end of the first guide rail.

According to one disclosed embodiment, the lever mechanism may comprise a lever arranged on the seat surface frame in a manner allowing rotation. In the folded-in state of the footrest the lever can extend forwards and downwards. It is especially possible for the lever to be arranged directly on the seat surface frame. In this case the direction "below" is to be understood in the context of this description to mean underneath when the seating furniture chassis is used as intended. The direction "front" is to be understood in the context of this description to mean the direction in which a user is looking when he is sitting on the seat surface frame when the seating furniture chassis is used as intended.

This direction of the lever is advantageous in that it is very easy for a user to trigger the fold out movement of the footrest by exerting a rearwards directed force on the seat surface frame. The user can perform this action, for example, by bracing himself against the armrests. Then the direction of the lever together with the shape of the first guide rail gives rise to the fold out movement of the footrest.

According to one disclosed embodiment, the lever may be connected to an element of the footrest in a manner allowing rotation. In the folded-in state of the footrest the lever can form an acute angle or a right angle with the element. In the folded-out state of the footrest the lever can form an obtuse angle with the element. This arrangement is advantageous for easy triggering of the fold out movement of the footrest and for a space saving arrangement of the footrest in the folded-in state underneath the seat surface frame.

According to one disclosed embodiment, the first guide rail may be arranged laterally next to the seat surface frame. This arrangement is to be understood in the context of this description to mean that the first guide rail is arranged next to a lateral end of the seat surface frame, with the lateral end extending from a rear end to a front end.

According to one disclosed embodiment, the seating furniture chassis may comprise a stand apparatus. The stand apparatus may be designed to stand on a flat surface in a stationary manner and to support the seat surface frame. The first guide rail can be rigidly connected to the stand apparatus.

According to one disclosed embodiment, the first guide element may protrude through the first guide rail.

According to one disclosed embodiment, the seating furniture chassis may comprise a second guide rail and a second guide element. When the footrest is converted from the folded-out state to the folded-in state and vice versa, the second guide element can be guided in the second guide rail. It is particularly possible for the second guide element to exhibit features that are described with reference to the first guide element in this description. The same applies mutatis mutandis to the second guide rail that may exhibit features that are described with reference to the first guide rail in this description. In particular, the second guide rail may have the same shape as the first guide rail.

The use of the second guide element and the second guide rail is advantageous for increasing the stability of the seating furniture chassis, in particular, when the footrest is folded out.

According to one disclosed embodiment, the first guide rail and the first guide element may be arranged laterally next to a first end of the seat surface frame. The second guide rail and the second guide element may be arranged laterally next to a second end of the seat surface frame. In this case, the first end may be arranged opposite the second end.

According to one disclosed embodiment, the seating furniture chassis may comprise a third and a fourth guide element and a third and a fourth guide rail. The third guide element and the third guide rail may be arranged laterally next to the first end of the seat surface frame. The fourth guide element and the fourth guide rail may be arranged laterally next to the second end of the seat surface frame.

When the footrest is converted from the folded-in state to the folded-out state and vice versa, the third guide element can be guided in the third guide rail; and the fourth guide element can be guided in the fourth guide rail.

The third and the fourth guide element and the third and the fourth guide rail can be arranged closer to a rear end region of the seat surface frame than the first guide element and the first guide rail. Therefore, a rear end of the seat surface frame can also be guided during a fold out or fold in movement.

According to one disclosed embodiment, the third guide rail and the fourth guide rail may have a curved shape.

According to one disclosed embodiment, the third guide rail and the fourth guide rail may each have a front end, a rear end and, arranged in-between, a central region. The rear end may be arranged lower than the central region and the front end. This shape, which users have often found to be easy to use, triggers a lowering of the rear region of the seat surface frame when the footrest is converted from the folded-in state to the folded-out state.

According to one disclosed embodiment, the third guide element may be arranged on the rear end of the third guide rail when the footrest is in the folded-out state. The fourth guide element may be arranged on the rear end of the fourth guide rail when the footrest is in the folded-out state.

According to one disclosed embodiment, the third guide element may be arranged on the front end of the third guide rail when the footrest is in the folded-in state. The fourth guide element may be arranged on the front end of the fourth guide rail when the footrest is in the folded-in state.

According to one disclosed embodiment, when the third guide element is guided in the third guide rail and when the fourth guide element is guided in the fourth guide rail, the third guide element and the fourth guide element respectively may be guided only horizontally and/or downwards when the footrest is converted from the folded-in state to the folded-out state.

According to one disclosed embodiment, the third guide element may be guided initially horizontally and thereafter downwards in the third guide rail; and the fourth guide element may be guided initially horizontally and thereafter downwards in the fourth guide rail when the footrest is converted from the folded-in state to the folded-out state. In this case the guidance downwards may include a movement that comprises both a horizontal and a vertical component.

According to one disclosed embodiment, the footrest may comprise an extending mechanism that is designed to make the footrest longer when the footrest is converted from the folded-in state to the folded-out state and to make the footrest shorter when the footrest is converted from the folded-out state to the folded-in state.

BRIEF DESCRIPTION OF THE DRAWINGS

Other features and advantages of the disclosed seating furniture chassis will become apparent from the following description of example embodiments with reference to the accompanying drawings. In this case, the same reference numerals are used for the same or similar components and for components with the same or similar functions. In the drawings.

DETAILED DESCRIPTION

Figures 1A, 1B:
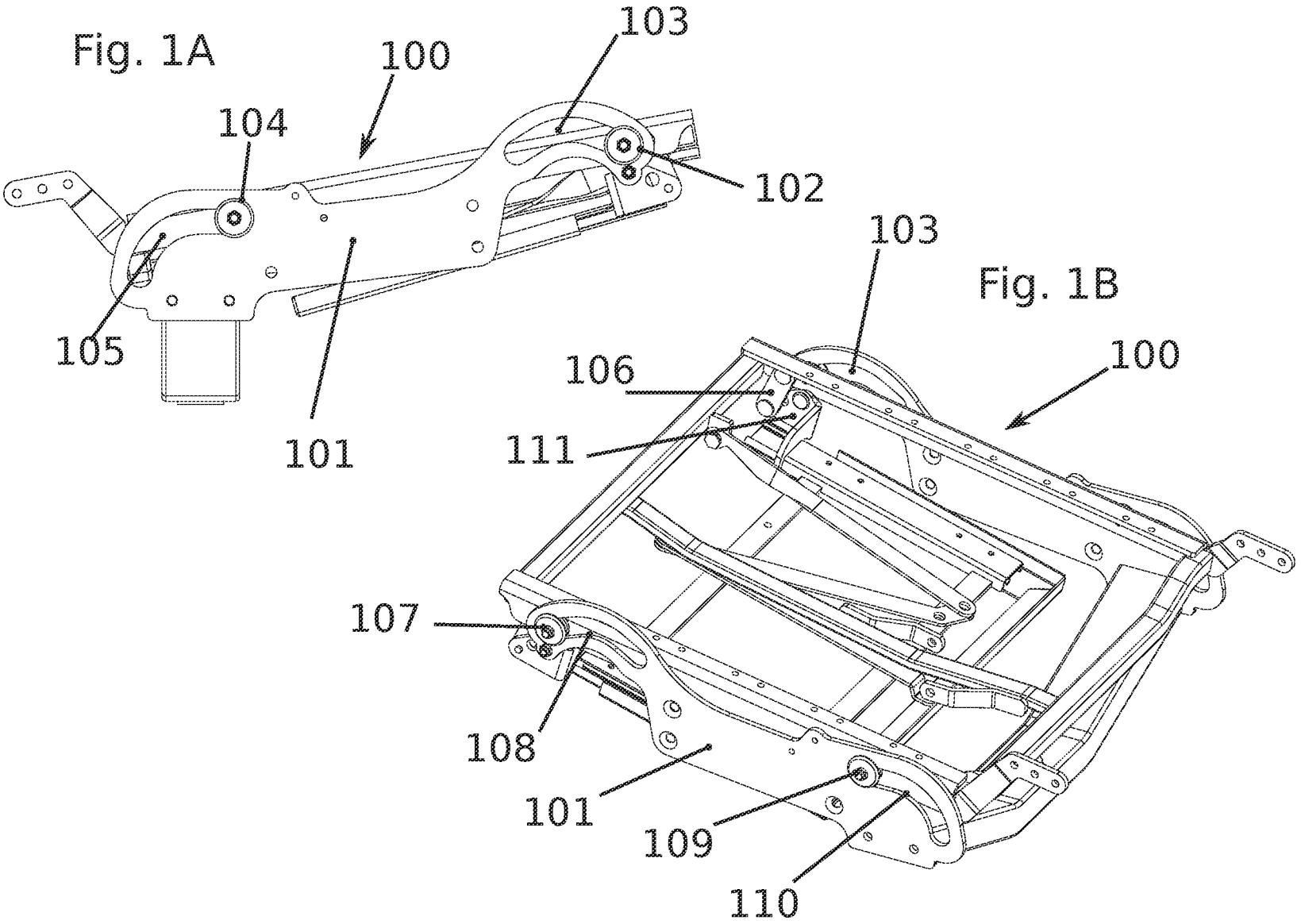
FIGS. 1A and 1B respectively show in schematic form two views of a seating furniture chassis, according to one disclosed embodiment, with a footrest in a folded-in state.
Figures 2A, 2B:
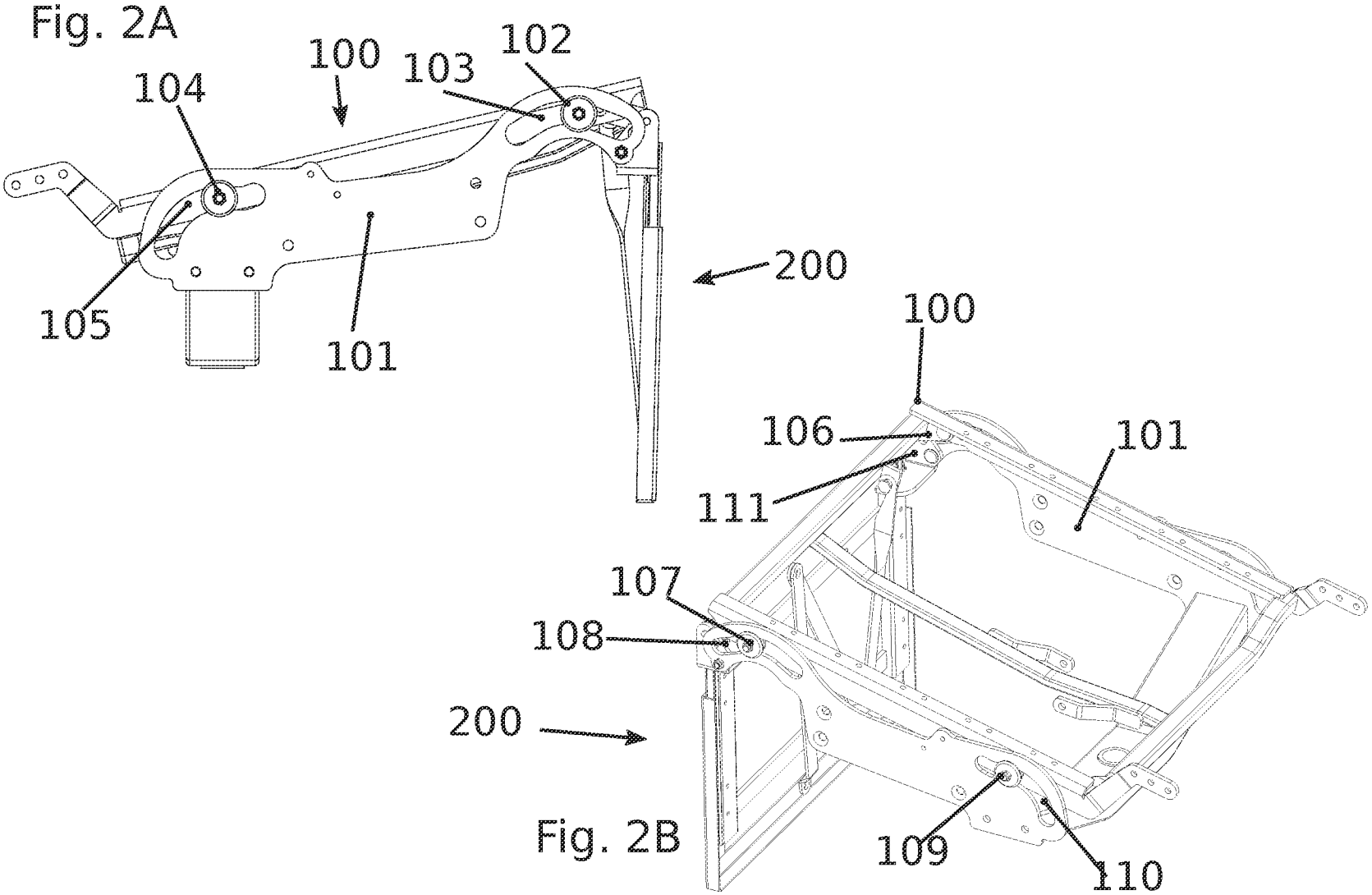
FIGS. 2A and 2B respectively show in schematic form two views of the seating furniture chassis of FIGS. 1A and 1B with the footrest between a folded-in state and a folded-out state.
Figure 3A:
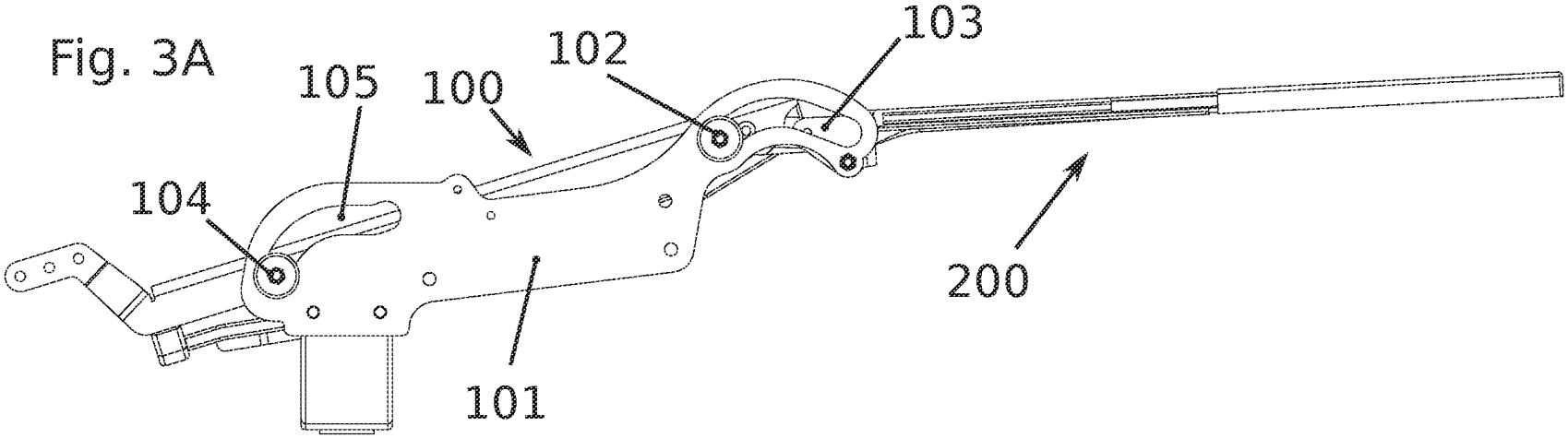
FIGS. 3A and 3B respectively show in schematic form two views of the seating furniture chassis of FIGS. 1A and 1B with the footrest in the folded-out state.
Figure 3B:
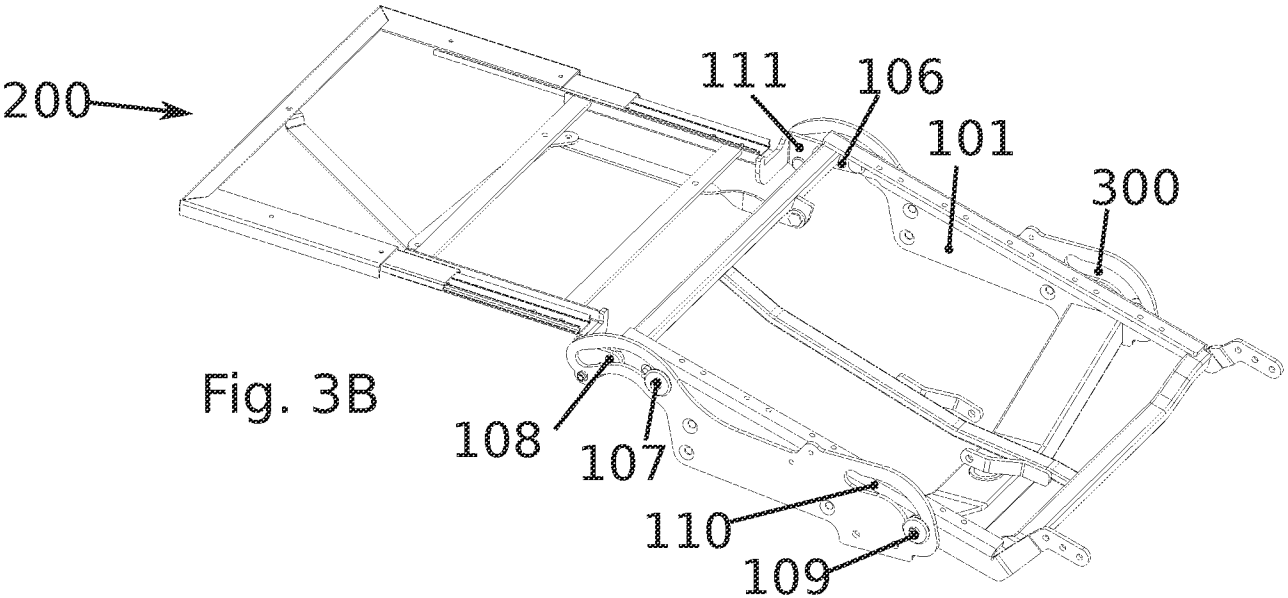

Referring to FIGS. 1A and 1B, a seating furniture chassis comprises a seat surface frame 100, a stand apparatus 101, a first guide element 102, a first guide rail 103, a second guide element 107, a second guide rail 108, a third guide element 104, a third guide rail 105, a fourth guide element 109, a fourth guide rail 110 and a footrest 200 (see FIGS. 2A, 2B, 3A and 3B).

The guide elements 102, 104, 107 and 109 are rigidly connected to the seat surface frame 100. The guide rails 103, 108, 105 and 110 are rigidly connected to the stand apparatus 101. In addition, the seat surface frame 100 is connected to the footrest 200 by a lever 106 and an element 111. The stand apparatus 101 serves to ensure that the seating furniture chassis stands stably on a flat surface.

The seat surface frame 100 can be displaced relative to the stand apparatus 101. During a displacement of the seat surface frame 100, the guide elements 102, 104, 107, and 109 are guided in the respective guide rails 103, 105, 108 and 110, so that the seat surface frame 100 is tilted during the displacement.

When the seat surface frame 100 is moved translationally by a force, exerted by a user, for example, out of the state of the seating furniture chassis (shown in FIGS. 1A and 1B) with a folded-in footrest 200, a fold out movement of the footrest 200 is triggered as a result of the seat surface frame 100 being connected to the footrest 200 by the lever 106 and the element 111. When the footrest is folded in, the lever 106 extends obliquely forwards and downwards. The force can be generated by the user, for example, in that he moves the seat surface frame 100 rearwards with his body. In this case he braces himself against the armrests that are connected to the stand apparatus 101.

The first guide rail 103 and the second guide rail 108 have a curved shape. In this case the front end, where the respective guide element 102 or 107 is located when the footrest is folded in, is arranged lower than a central region of the guide rail 103 or 108. The same applies analogously to the rear end in each case. The guide elements 102 and 107 are arranged on the rear end, when the footrest 200 is in the folded-out state. Thus, the seat surface frame 100 is first pivoted upwards on the end facing the footrest, when the footrest 200 is converted from the folded-in state to the folded-out state. The result of this movement together with the direction of extension of the lever 106 is that the fold out movement of the footrest 200 can be triggered by the user moving the seat surface frame 100 rearwards.

During the fold out process of the footrest 200, shown in stages in FIGS. 2A, 2B, 3A, and 3B, the angle between the lever 106 and the element 111 changes. In the folded-in state of the footrest 200, an upper end of the element 111 forms an acute angle with the lever 106, while a lower end of the element 111 forms a right angle with the lever 106. The angle between the lever 106 and the element 111 becomes larger during the fold out process of the footrest 200 so that in the folded-out state the footrest 200 is arranged in a position that is comfortable for a user. In the folded-in state, the footrest is arranged close to the seat surface frame 100 in a particularly space saving manner.

The third guide element 104 and the fourth guide element 109 are arranged on a rear end of the seat surface frame 100, so that their guidance via the third guide rail 105 and the fourth guide rail 110 during the fold out process of the footrest 200 determines a tilt of the rear end of the seat surface frame 100. The third guide rail 105 and the fourth guide rail have a curved shape, with a front end being arranged higher than a rear end. This arrangement is advantageous for a comfortable tilt of the seat surface frame 100, when the footrest 200 is in the folded-out state.

What is claimed is:

1. A seating furniture chassis, comprising:

a seat surface frame;

a lever mechanism;

a footrest connected to the seat surface frame by the lever mechanism, the footrest being convertible between a folded-in state in which the footrest is arranged below the seat surface frame and a folded-out state in which the footrest forms an obtuse angle with the seat surface frame;

a first guide element arranged laterally next to a first end of the seat surface frame and rigidly connected to the seat surface frame;

a first guide rail arranged laterally next to the first end of the seat surface frame and having a curved shape comprising a front end, a rear end, and a central region arranged between the front and rear ends, wherein the front and rear ends are arranged lower than the central region;

a second guide element arranged laterally next to a second end of the seat surface frame;

a second guide rail arranged laterally next to the second end of the seat surface frame;

a third guide element arranged laterally next to the first end of the seat surface frame;

a third guide rail having a curved shape and arranged laterally next to the first end of the seat surface frame;

a fourth guide element arranged laterally next to the second end of the seat surface frame; and a fourth guide rail having a curved shape and arranged laterally next to the second end of the seat surface frame, wherein:

when the footrest is converted between the folded-out and folded-in states, the first guide element is guided in the first guide rail, when the footrest is converted between the folded-in and folded-out states, the third guide element is guided in the third guide rail and the fourth guide element is guided in the fourth guide rail, during guidance in the third and fourth guide rails, respectively, the third and fourth guide elements are guided only horizontally and downwards when the footrest is converted from the folded-in state to the folded-out state, the lever mechanism comprises an elongated lever having an upper portion that is directly connected rotatably to the seat surface frame, a lower portion, and a longitudinal axis extending from the upper portion to the lower portion, and the longitudinal axis of the lever extends in a forward and downward direction from the seat surface frame in the folded-in state of the footrest.

2. The seating furniture chassis of claim 1, wherein the first guide element in the folded-out state of the footrest is arranged on the rear end of the first guide rail.

3. The seating furniture chassis of claim 1, wherein the first guide element in the folded-in state of the footrest is arranged on the front end of the first guide rail.

4. The seating furniture chassis of claim 1, wherein:

the footrest further comprises an element and the lower portion of the lever is connected rotatably to the element;

in the folded-in state of the footrest, the lever forms an acute angle or a right angle with the element; and in the folded-out state of the footrest, the lever forms an obtuse angle with the element.

5. The seating furniture chassis of claim 1, further comprising a stand apparatus configured to stand stationarily on a flat surface and to support the seat surface frame, and wherein the first guide rail is rigidly connected to the stand apparatus.

6. The seating furniture chassis of claim 1, wherein the first guide element protrudes through the first guide rail.

7. The seating furniture chassis of claim 1, wherein, when the footrest is converted between the folded-out and folded-in states, the second guide element is guided in the second guide rail, and wherein the second guide rail has the same curved shape as the first guide rail.

8. The seating furniture chassis of claim 1, wherein the first end of the seat surface frame is arranged opposite the second end of the seat surface frame.

9. The seating furniture chassis of claim 1, wherein the third and fourth guide elements and the third and fourth guide rails are arranged closer to a rear end region of the seat surface frame than the first guide element and the first guide rail.

10. The seating furniture chassis of claim 1, wherein the third and fourth guide rails each have a front end, a rear end, and a central region arranged between the front and rear ends, and wherein the rear end is arranged lower than the central region and the front end.

11. The seating furniture chassis of claim 10, wherein, in the folded-out state of the footrest, the third guide element is arranged on the rear end of the third guide rail and the fourth guide element is arranged on the rear end of the fourth guide rail.

12. The seating furniture chassis of claim 10, wherein, in the folded-in state of the footrest, the third guide element is arranged on the front end of the third guide rail and the fourth guide element is arranged on the front end of the fourth guide rail.

13. The seating furniture chassis of claim 1, wherein, during guidance in the third and fourth guide rails, respectively, the third and fourth guide elements are guided initially horizontally and thereafter downwards when the footrest is converted from the folded-in state to the folded-out state.

14. The seating furniture chassis of claim 1, wherein the footrest comprises an extending mechanism to make the footrest longer during conversion from the folded-in state to the folded-out state and to make the footrest shorter during conversion from the folded-out state to the folded-in state.

* * * * *